US010633963B1

(12) United States Patent
Perry et al.

(10) Patent No.: US 10,633,963 B1
(45) Date of Patent: Apr. 28, 2020

(54) METHOD AND APPARATUS FOR REMOVING GAS FROM GAS PRODUCING FORMATIONS

(71) Applicants: Michael S. Perry, Denver, CO (US); Gerald Luken, Gilette, WY (US); Cory Luken, Gilette, WY (US)

(72) Inventors: Michael S. Perry, Denver, CO (US); Gerald Luken, Gilette, WY (US); Cory Luken, Gilette, WY (US)

( * ) Notice: Subject to any disclaimer, the term of this patent is extended or adjusted under 35 U.S.C. 154(b) by 266 days.

(21) Appl. No.: 15/355,929

(22) Filed: Nov. 18, 2016

Related U.S. Application Data

(60) Provisional application No. 62/257,970, filed on Nov. 20, 2015.

(51) Int. Cl.

| | |
|---|---|
| ***E21B 43/38*** | (2006.01) |
| ***E21B 43/08*** | (2006.01) |
| ***E21B 43/00*** | (2006.01) |

(52) U.S. Cl.
CPC ..... *E21B 43/38* (2013.01); *E21B 43/006* (2013.01); *E21B 43/084* (2013.01); *E21B 43/088* (2013.01)

(58) Field of Classification Search
CPC ..... E21B 43/08; E21B 43/082; E21B 43/084; E21B 43/086; E21B 43/088; E21B 43/34; E21B 43/36; E21B 43/38; E21B 43/385
See application file for complete search history.

(56) References Cited

U.S. PATENT DOCUMENTS

| | | | | |
|---|---|---|---|---|
| 2,877,852 A * | 3/1959 | Bashara | E21B 43/08 166/230 |
| 5,673,752 A * | 10/1997 | Scudder | B01D 19/0031 166/230 |
| 6,228,146 B1 * | 5/2001 | Kuespert | B01D 61/00 166/105.5 |
| 2011/0011586 A1 * | 1/2011 | Dusterhoft | E21B 43/08 166/278 |

OTHER PUBLICATIONS

Schlumberger Oilfield Glossary—Liner—Accessed 2019 https://www.glossary.oilfield.slb.com/en/Terms/l/liner.aspx (Year: 2019).*
Schlumberger Oilfield Glossary—Casing—Accessed 2019 https://www.glossary.oilfield.slb.com/Terms/c/casing.aspx (Year: 2019).*

* cited by examiner

*Primary Examiner* — David Carroll
(74) *Attorney, Agent, or Firm* — Reilly International Property Law Firm

(57) ABSTRACT

A method and apparatus for removing dissolved gas from a coal bed or other type of gas bearing formation is provided.

15 Claims, 13 Drawing Sheets

METHOD AND APPARATUS FOR REMOVING GAS FROM GAS PRODUCING FORMATIONS

CROSS-REFERENCE TO RELATED APPLICATIONS

This application claims the benefit of U.S. Provisional Application No. 62/257,970 filed on Nov. 20, 2015 for METHOD AND APPARATUS FOR REMOVING GAS FROM GAS PRODUCING FORMATIONS and is incorporated by reference herein.

FIELD

The present method and device relates to gas extraction from wells. In particular, it relates to a method and apparatus for passive recovery of in ground gas from gas producing formations in which the formation waters have gas dissolved in them.

BACKGROUND

Removal of gas from gas producing formations is generally accomplished by separating gas from liquids present in the formations. For example, coal bed methane is a form of natural gas that can be extracted from coal bed formations. Coal bed methane is methane gas that is contained in coal seams as a result of chemical and physical processes. Methane is adsorbed into the matrix of the coal and lines the inside pores within the coal. It is often produced at shallow depths through a bore hole that allows gas and water to be produced.

Extraction of coal bed methane is known in the prior art and generally, to extract methane, a steel encased hole is drilled into the coal seam of less than 300 to over 4,920 feet below the surface of the ground. As the pressure within the coal seam declines due to pumping of water from the coalbed, both gas and water can surface through the pump tubing. More commonly, formation water is extracted through the tubing and the isolated coal bed methane gas travels upwardly from the casing of the wellbore and is collected at the surface. The gas is generally sent to a compressor station and into natural gas pipelines. The formation or produced water is either reinjected into isolated wells, or if it does not contain contaminants, released into streams, used for irrigation, or sent to evaporation ponds. The formation water typically contains dissolved solids such as sodium bicarbonate and chloride but its chemistry will vary depending upon the geographic location of the well.

The production of coal bed methane from formations is typically characterized by a negative decline in which the gas production rate initially increases as the water is pumped off and gas begins to desorb and flow. Desorption is the process by which coals free methane when the hydrostatic pressure in the coal formation is reduced. The methane desorption process follows a curve (of gas content vs. reservoir pressure) called a Langmuir isotherm. The isotherm can be defined by a maximum gas content (at infinite pressure), and the pressure at which half that gas exists within the coal. These parameters (called the Langmuir volume and Langmuir pressure, respectively) are properties of the coal, and vary widely depending upon the physical and chemical characteristics of the coal and the geographic location. As production occurs from a coal reservoir, the changes in pressure are believed to cause changes in the porosity and permeability of the coal. This is commonly known as matrix shrinkage/swelling.

Many coal bed methane producing formations have been drilled and abandoned or drilled and shut in, leaving orphaned wells that still possess gas pressure. As an alternative to the pumping of water off of the coals to produce gas or plugging and reclaiming wells, the current isolation provides an apparatus and method for continued recovery of coal bed methane from coal bed methane formations without releasing or removing formation water. In addition, there are many shallow gas wells which produce gas from rock types other than coal in which the hydrostatic head of the produced water is greater than the gas bearing formations reservoir pressure. The current apparatus will also allow gas to be produced in these formations and wells. In accordance with the disclosure, there is provided a downhole isolation tool for introduction within a casing of a gas formation, having an upper open end for reception of a tubing assembly, the tool comprising a circumferential multi-part housing with the upper open end; the housing having an internal cavity for insertion of a perforated cylindrical internal tool, a wire mesh screen, a sleeve member; and a perforated bore tail.

BRIEF DESCRIPTION OF THE DRAWINGS

The accompanying drawings, which are incorporated and which constitute a part of the specification, illustrate at least one embodiment of the present device.

DETAILED DESCRIPTION OF FIRST EMBODIMENT

Figure 1:
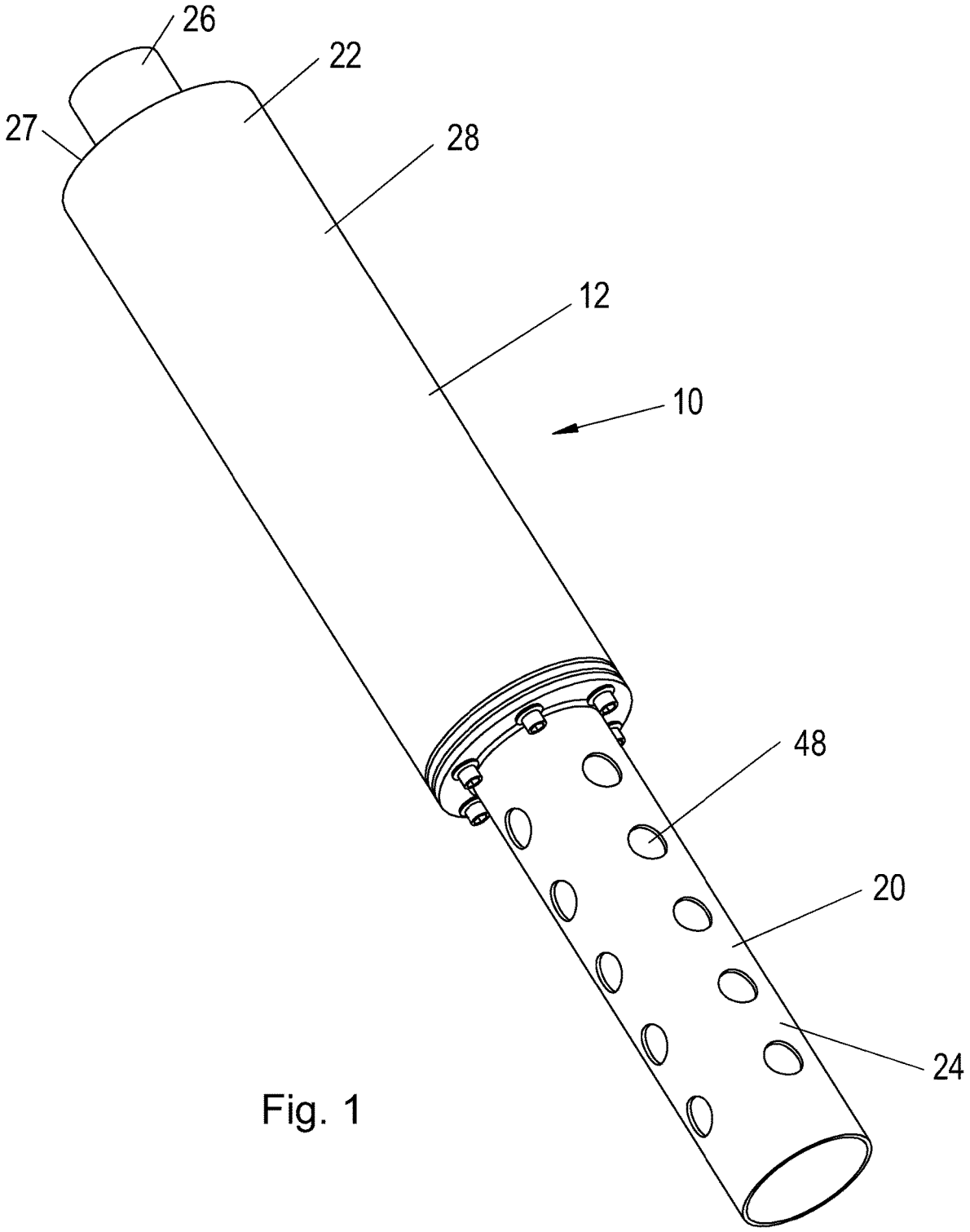
FIG. 1 is a perspective view of the downhole gas recovery tool.
Figure 2:
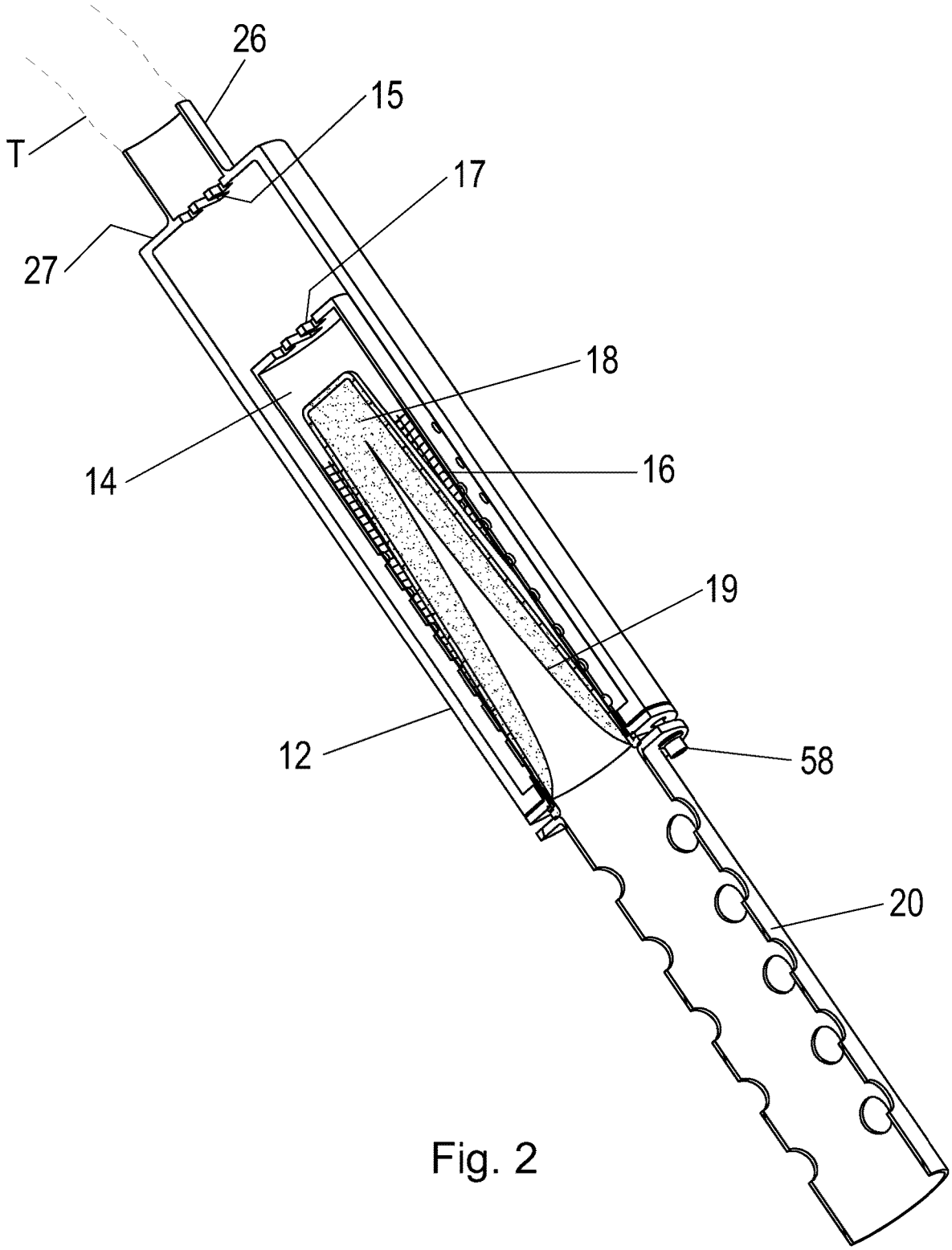
FIG. 2 is a sectional view about lines 2-2 of FIG. 1.
Figure 5:
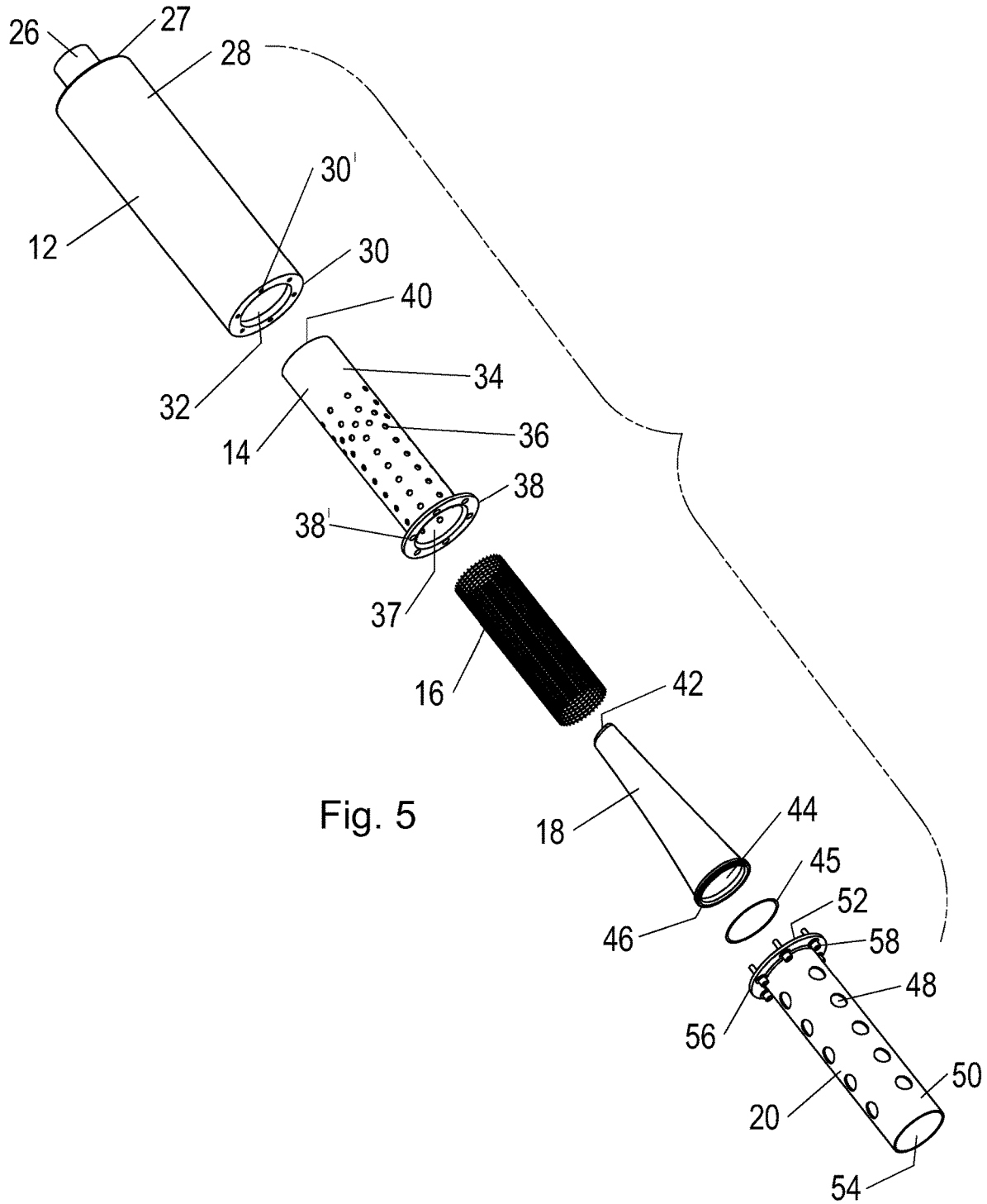
FIG. 5 is an exploded view of FIG. 1
Figure 6:
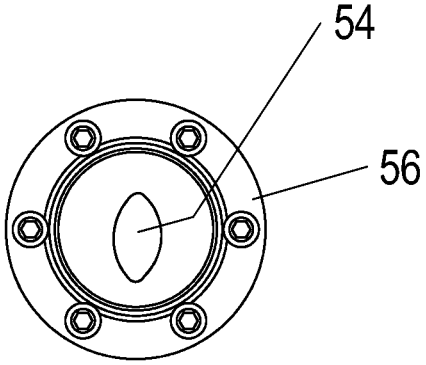
FIG. 6 is a bottom view of FIG. 1.
Figure 7:
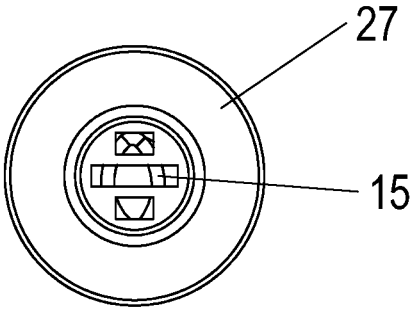
FIG. 7 is a top view of FIG. 1.
Figure 8:
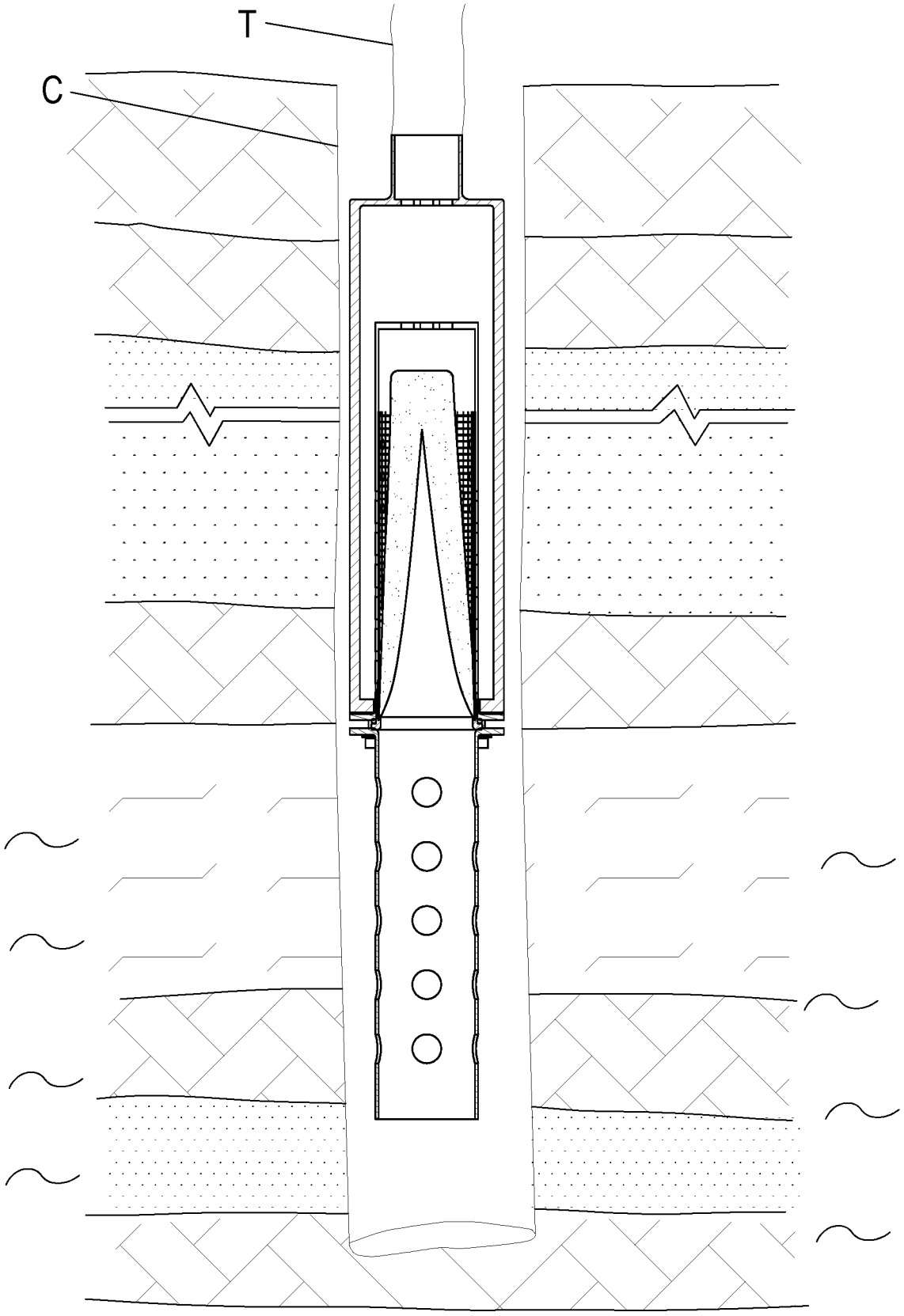
FIG. 8 is a sectional view as shown in FIG. 4 including a sectional view of a gas producing formation.
Figure 9:
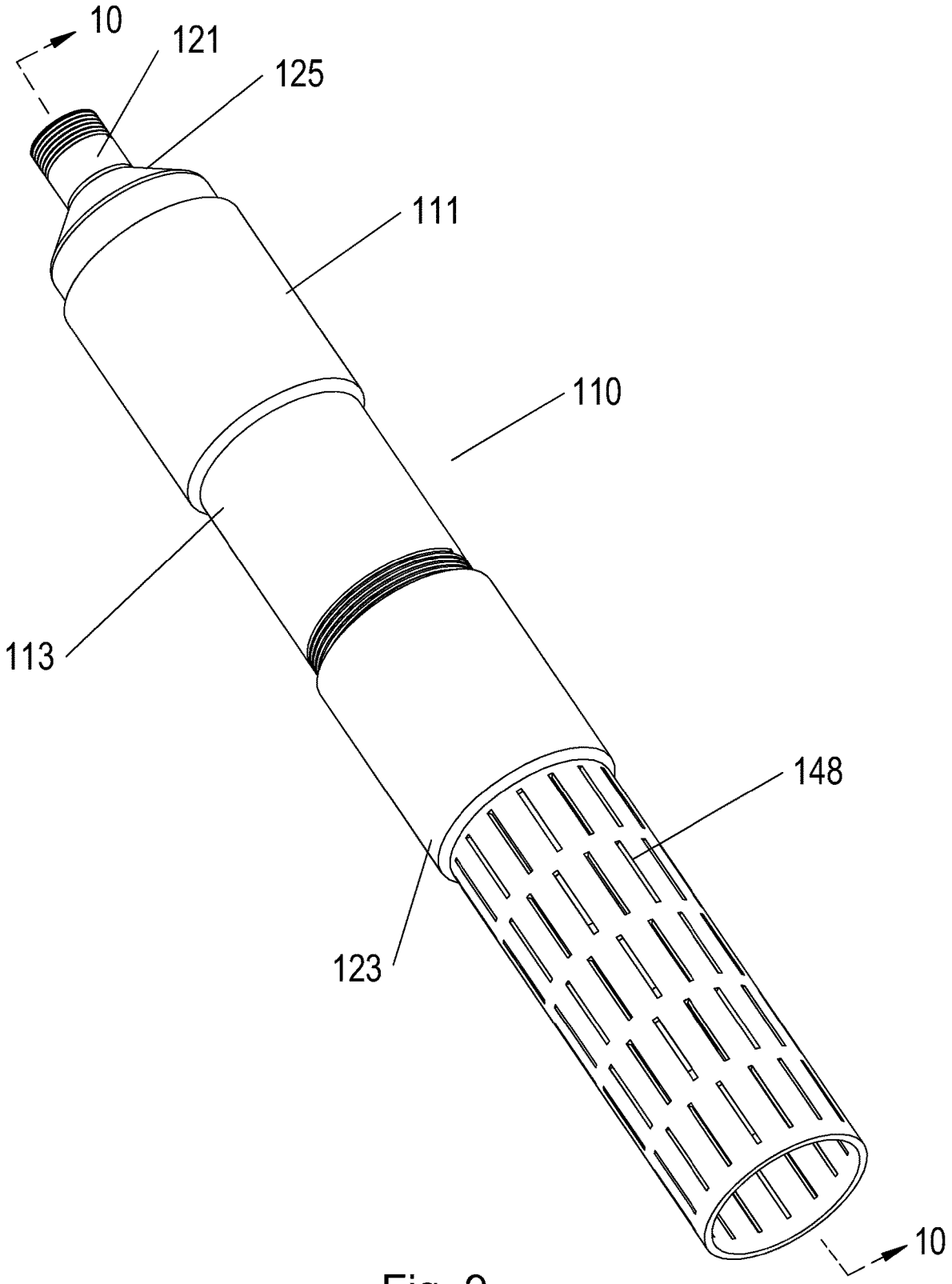
FIG. 9 is a perspective view of a second form of downhole gas recovery tool.
Figure 10:
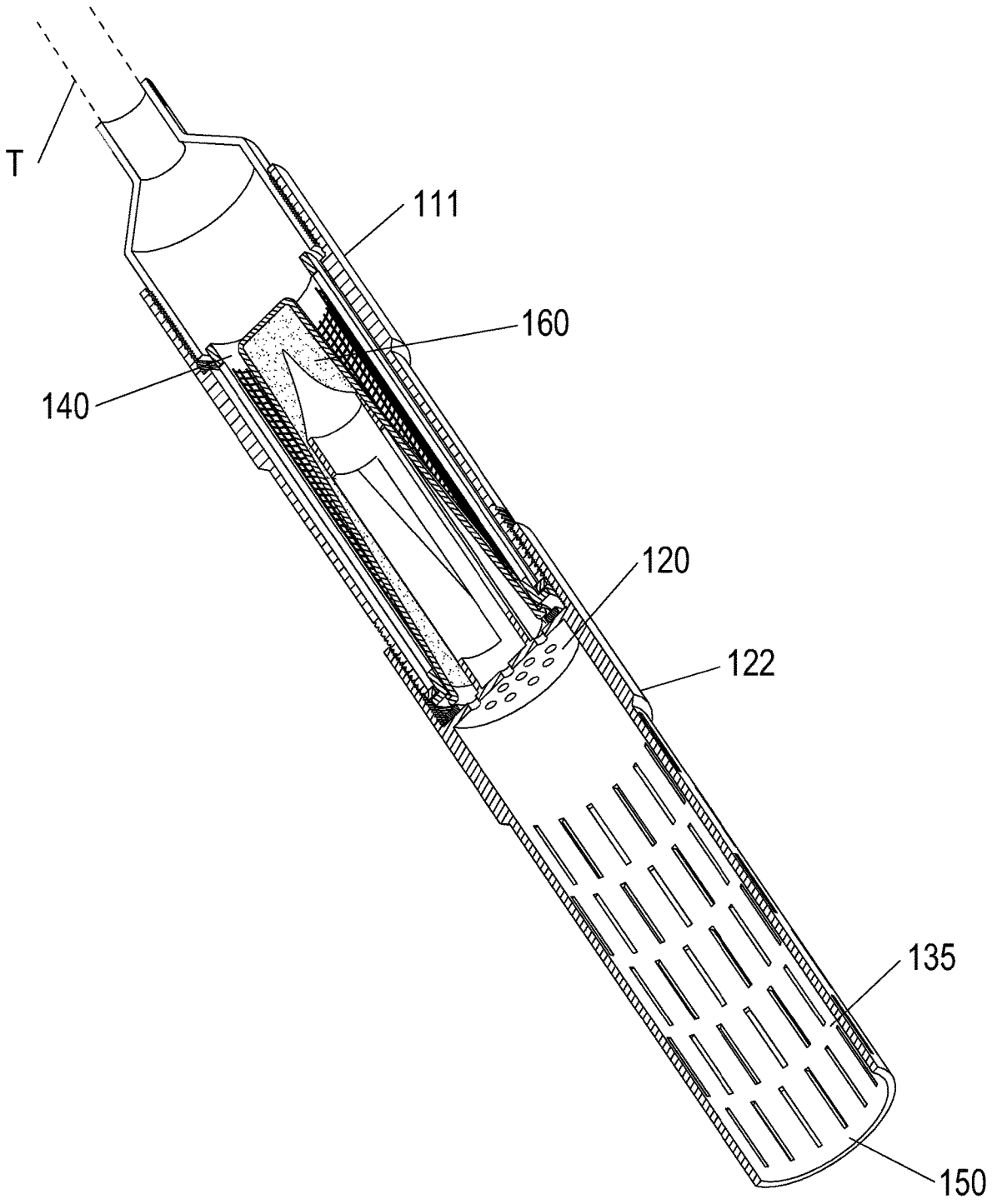
FIG. 10 is perspective sectional view about lines 10-10 of FIG. 9.

A passive downhole isolation device 10 is provided and shown in FIGS. 1-8. More specifically, as shown in FIG. 5, the device 10 has an external circumferential housing 11, a cylindrical internal tool insert 14, a wire mesh cage 16, a hydrophobic sleeve member 18 and a perforated bore tail 20. The downhole isolation tool is designed to be positioned within a cased well bore C as shown in FIG. 8. The isolation tool preferably comprises upper and lower isolation sections 22 and 24, as shown in FIG. 1, with the upper isolation section 22 defined by the housing 12 made up of an interior tool annulus 32 that is designed to house the internal tool insert 14. The housing 12, perforated tool insert 14 and bore tail 20 are all preferably made up of non-corrosive steel, aluminum, polypipe, plastic or other suitable material.

As shown in FIGS. 1, 2, 4 and 5, the upper section 22 includes the external housing 12 which is of cylindrical configuration having an upper neck coupling 26, a top plate or collar 27, cylindrical walls 28, a lower base rim 30 and internal cavity or annulus 32. The top plate 27 is circumferentially positioned around the neck coupling 26. The coupling 26 is designed to be positioned below the static water level in the wellbore by various amounts depending on the reservoir characteristics of the gas bearing formation and allows gas to flow up the tubing T to gathering and sales pipelines (not shown). The tubing T is threaded into the neck coupling 26, which is securely welded on to the top of plate 27. The top plate 27 forms a part of the upper section 22 which is positioned below the static water level within the wellbore. The internal tool annulus 32 and the base rim 30 of the upper section 22 are sized to accommodate the perforated tool insert 14. The tool insert 14 is defined by cylindrical walls of non-corrosive steel, aluminum, polypipe, plastic or other suitable material any size diameter from 2" to over several feet as long as it will fit into upper section 22 having circumferentially aligned, radially spaced perforations 36, preferably along a lower mid-portion of the tool insert 14, an internal cavity 37, an outwardly extending rim member 38 having an opposite open end 40 from the rim member 38. A mesh wire screen cage 16 may be inserted within the internal cavity 37 to line the interior cylindrical walls in touching relation to the perforations 36. The mesh screen is preferably 10 mesh, stainless steel but can be of different composition and still be within the scope of this disclosure.

Figures 3, 4, 4A:
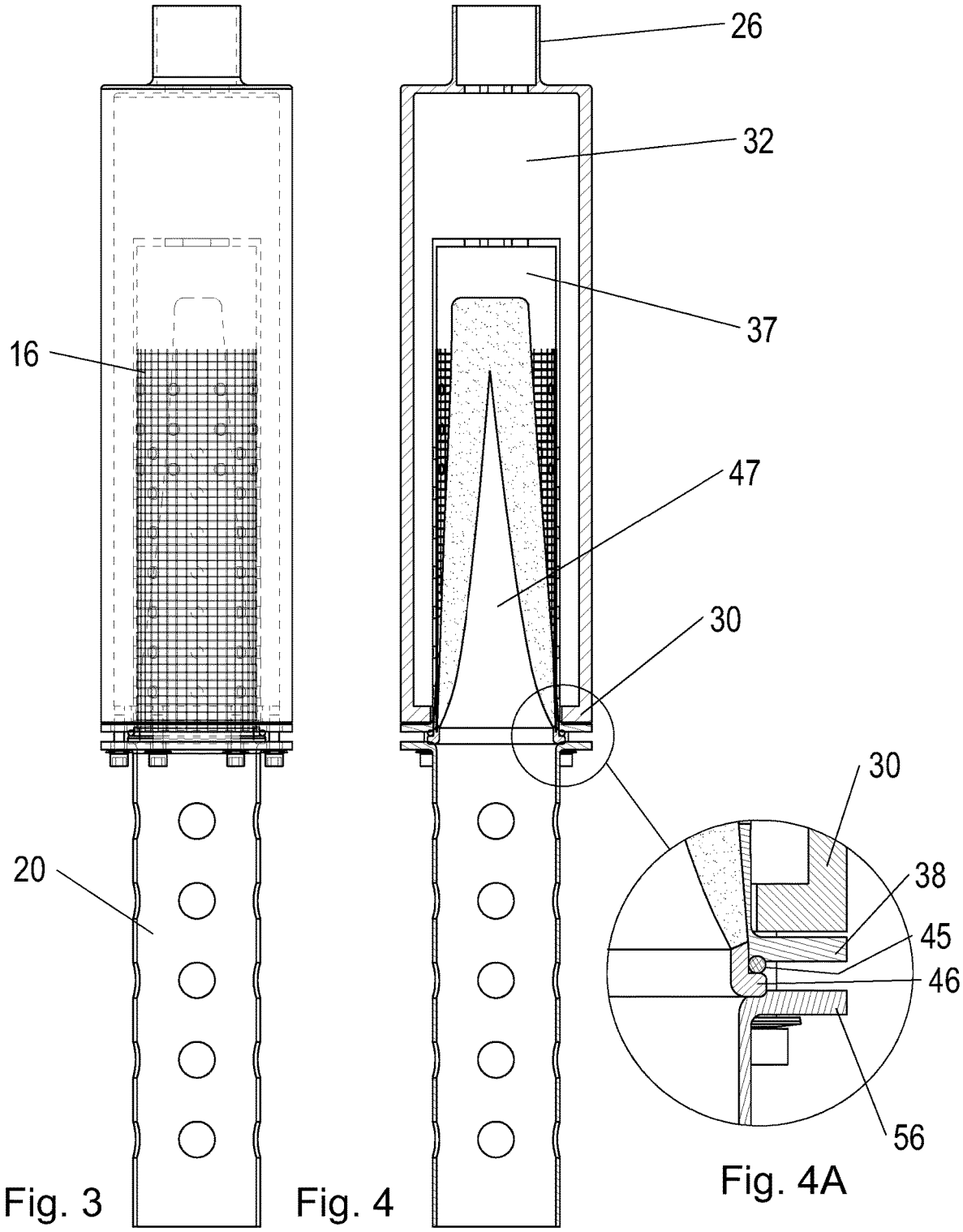
FIG. 3 is a side view of FIG. 1.
FIG. 4 is a cross-sectional view about lines 2-2 of FIG. 1.
FIG. 4A is a detail view of FIG. 4.

The hydrophobic sleeve member 18 includes a cylindrical rim member 46 that maintains the position of the sleeve member within the tool insert 14. The tool insert 14 also includes a flat or O-ring 45 positioned between the rim member 46 and the bore tail 20 to ensure a tight connection between the upper and lower sections 22 and 24 as shown in FIG. 4A. The sleeve member is preferably made up of hydrophobic material having a single open end 44, closed end 42, and the cylindrical rim member 46 for support. The preferred material for the sleeve member 18 is polypropylene but may be comprised of any other hydrophobic fibers such as polyester, nylon, or polypropylene. These fibers may be in the form of staple yarns, flat continuous multi-filaments, or texturized continuous multi-filaments. The hydrophobic nature of the sleeve may also be accomplished using hydrophobic and super hydrophobic coatings such as polymethylhydrosiloxane (PMHS) and polyvinyl chloride (PVC), as an example. The sleeve member is preferably of 1 micron pore size but may also be in the range of 0.6 to 1.1 micron pore size to allow for passage of vaporized gas. The sleeve member 18 is inserted into the cavity 37 of tool insert 14 with the mesh screen 16 located therebetween. The placement of the mesh wire screen 16 between the interior of the tool insert 14 and the sleeve member 18 prevents the sleeve member 18 from passing through the perforations 36. The mesh wire screen 16 preferably lines up with the perforations 36 on the tool insert 14.

The bore tail 20 is of cylindrical configuration with circumferential perforations 48 in the wall 50 and also having dual openings 52, 54 and acts as a solid separation tool. The perforations 48 are sized to allow passage of liquid therethrough but prevent passage of large solids into internal opening or cavity 54. Upper opening 52 has an outwardly extending rim 56 that is designed to correspond with rim member 38 and rim member 30 for secured engagement using upwardly extending threaded bolts 58. The bolts are designed to pass through bolt openings 38' and 30' thereby securing the upper and lower sections together and retaining the sleeve member 18 in place. The dimensional length of each portion of the tool is designed to allow fluid to travel the length of the lower and upper sections to allow for separation of the gas from the production fluid. Preferably, the upper and lower sections 22 and 24 are of roughly the same length but variations in dimensions are possible without departing from the scope of the disclosure.

In use, the tool 10 is set below the static water level in the wellbore. The depth below the static fluid level the tool is positioned varies depending on the characteristics of the gas reservoir, as a general rule the closer the tool is set to the gas bearing formation, the better. The lower section 24 of the tool 10 receives gas combined with formation liquid from the well reservoir through the encased well bore. The bore tail 20 restricts large solids from entering the bore tail passageway 54 due to the restrictive perforations 48. A mixture of gas and liquid is generated within the bore tail 20 with the pressure forcing the mixture into the upper section 22 of the tool 10.

For example, if the tool is set one hundred feet below the static fluid level, this creates a hydrostatic pressure of approximately 43 psi at this depth under fresh (non-salt) water. The tubing T and tool annulus 32 are isolated from the approximately 43 psi of hydrostatic pressure by the hydrophobic sleeve membrane 18. The tubing pressure (and pipeline pressure) are preferably maintained at 5 psi to 20 psi. This creates a pressure sink inside the annulus 32 of the difference between the approximately 43 psi hydrostatic head and pressure inside the tool annulus 32; tubing T and the surface gas pipelines (not shown). For example, if the tubing T pressure is 10 psi, the pressure differential is 33 psi ((43 psi (hydrostatic head) −10 psi (tubing T pressure)). The side 19 of the hydrophobic membrane in contact with the formation water (opposite the wire mesh) is set at a depth in the wellbore such that the hydrostatic pressure at that depth is greater than the pressure on the side of the hydrophobic membrane that is in contact with the wire mesh 16 and insert tool 14 and consequently the annulus 32 that is in communication with the tubing T up to the surface.

By its very nature, gas will flow towards a point of lowest pressure in the wellbore. The gas dissolved in the coal (or other rock type) formation or production water will flow towards the pressure sink and be liberated from the fluid or water within the interior 47 of the sleeve member 18, pass thru the hydrophobic membrane 18, the mesh cage 16, the tool insert perforations 36 and into the tool annulus 32. The liberated gas then travels upwardly through tool insert passageway 17, upper passageway 15 and up the tubing T into the gas gathering pipeline. Formation fluid or water remains within the interior 47 and generally is not forced upwardly into the tubing T due to the hydrophobic sleeve 18.

DETAILED DESCRIPTION OF SECOND EMBODIMENT

A second form of passive downhole isolation device 110 is provided and shown in FIGS. 9-14 and 17. More specifically, as shown in FIGS. 9-12, the device 110 has an upper section of the tool 113 with an external housing 111 which is of cylindrical configuration having an upper neck coupling 121, collar 125, lower threads 117. The housing 111 includes interior threads for engagement with lower threads 117, exterior housing 111, a circumferential housing 115, an aluminum or steel compression ring 124, a perforated cylindrical internal tool insert 112 with a steel compression ring 138, a wire mesh screen 116, a hydrophobic sleeve member 118 with an aluminum flange ring 146, an aluminum separator seal locking ring 128, a gas/water internal separator support 114, a perforated baffle plate 120, a slip collar 122, and a bore tail 135. This form consists of a break down tool that may be assembled to a length of at least 2' to 40' or longer. The components are of shorter length to provide for easy manufacturing, transport and assembly on site. The components are also easily disassembled with a multitude of threaded members. The threaded members are an alternative to use of bolts and other securing mechanisms that may easily fail or corrode over time. The extended length provides additional surface area for gas/water separation allowing for a more efficient separation.

Figure 17:
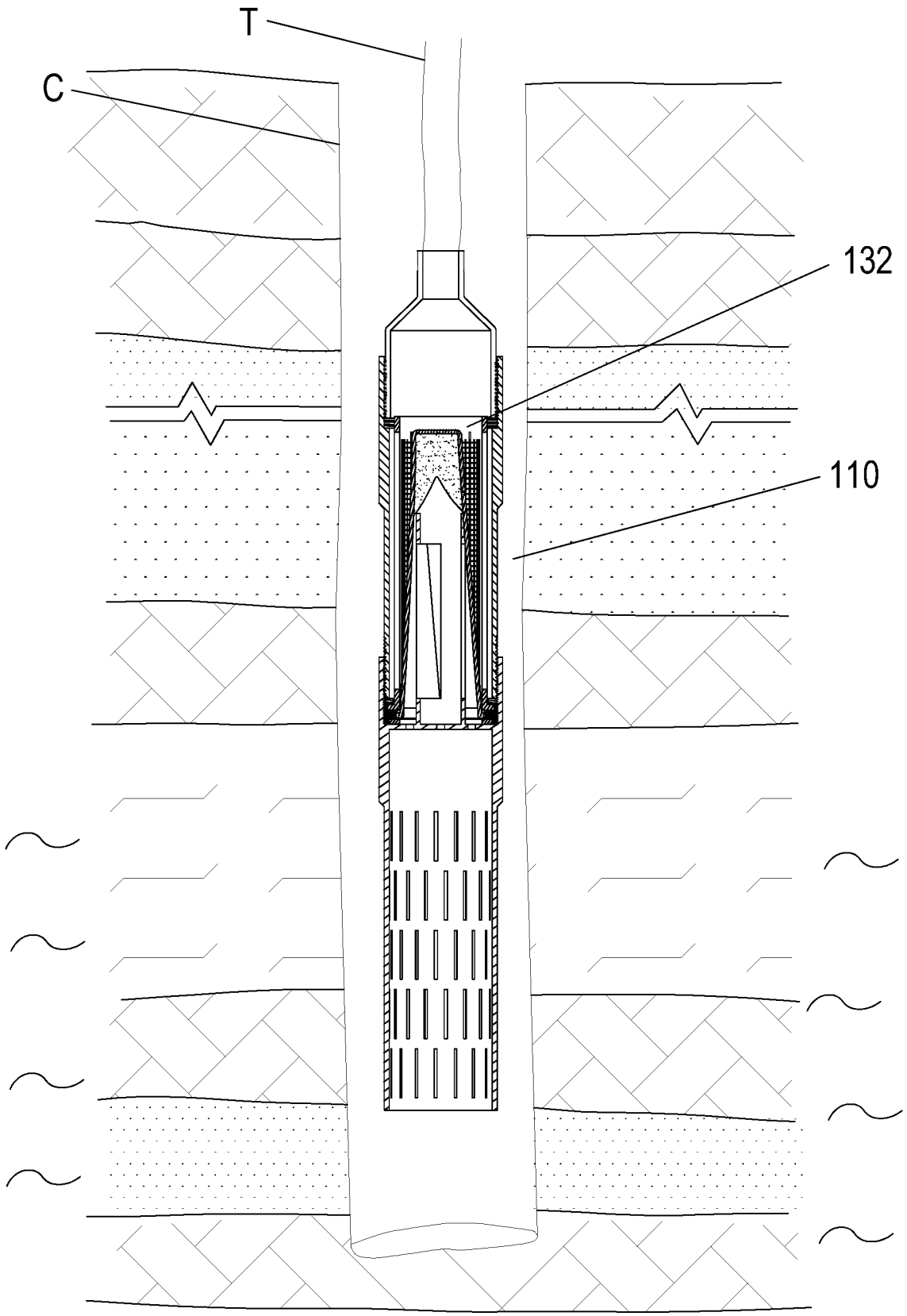
FIG. 17 is a sectional view as shown in FIG. 11 including a sectional view of a gas producing formation.

The downhole isolation tool 110 is designed to be positioned within a cased well bore C as shown in FIG. 17. The isolation tool preferably comprises the exterior housing 111 that is made up of 2' to several feet in diameter steel or other non-corrosive material, ranging in length from 2 feet and up to 40 feet and beyond depending upon the diameter of the wellbore and reservoir characteristics of the gas bearing formations. An upper section of the tool 113 has the external housing 111 which is of cylindrical configuration having the upper neck coupling 121, collar 125, lower threads 117, the housing 111 includes interior threads for engagement with lower threads 117, cylindrical wall housing 115 with exterior threading 119 is designed to house interior gas separation elements. The upper section 113 as well as lower section 123 are preferably made up of non-corrosive steel or aluminum.

As shown in FIGS. 9-14 and 17, the upper section 113 includes an internal cavity or annulus 132. The collar 125 is circumferentially positioned around the neck coupling 121. The coupling 121 is designed to be positioned below the static water level in the wellbore and allows gas to flow up the tubing T to gathering and sales pipelines (not shown). The tubing T is threaded into the neck coupling 121. The internal tool annulus 132 and the housing 115 are sized to accommodate the perforated tool insert 112. The tool insert 112 is defined by cylindrical walls of 4" aluminum having circumferentially aligned, radially spaced perforations 130, preferably along the entire length of the tool insert, an internal cavity 137 and an outwardly extending rim member 138 having an opposite open end 140 from the rim member 138.

Figure 12:
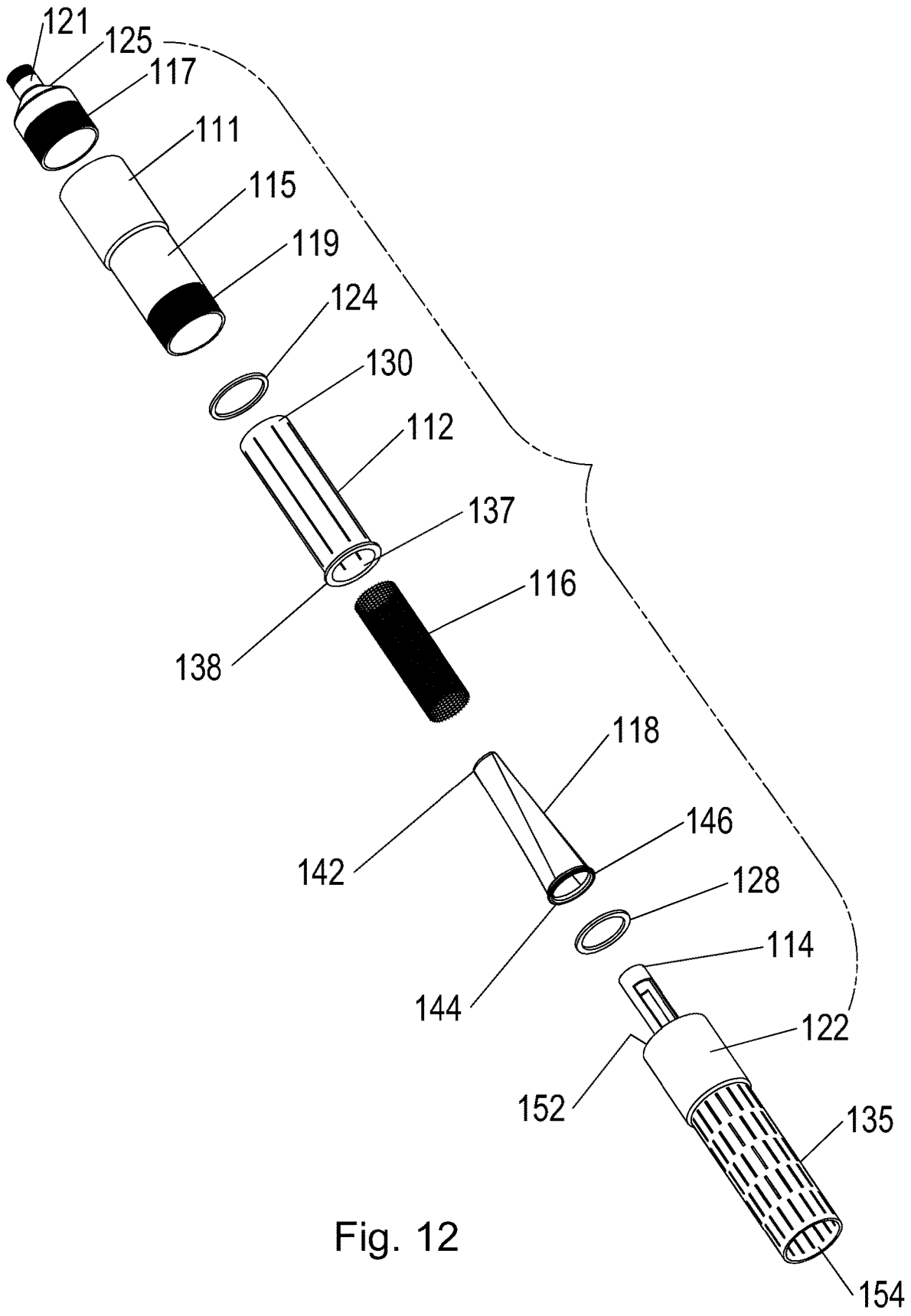
FIG. 12 is an exploded view of FIG. 9.
Figure 13:
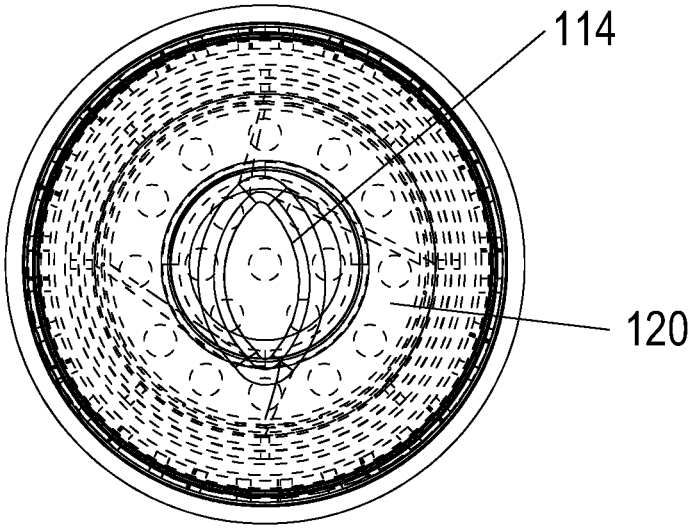
FIG. 13 a top view of FIG. 9.
Figure 14:
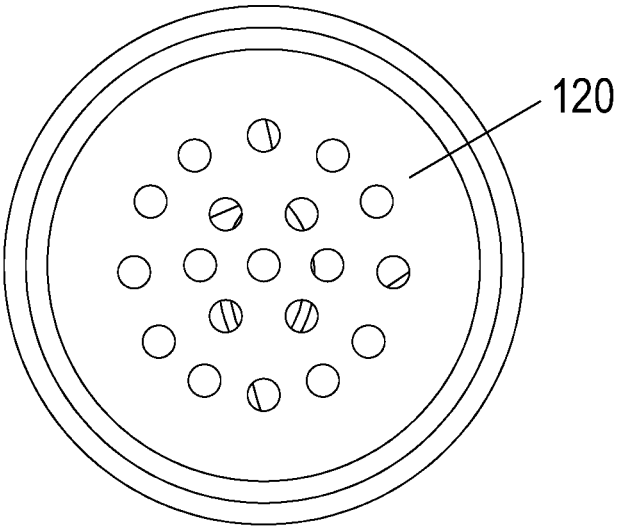
FIG. 14 is a bottom view of FIG. 9.

One end of the housing 115 has internal threads for connection to the housing 111 and neck coupling 121 and lower threaded members 119 for threaded attachment to lower collar 122. The exterior housing is designed to house section 112, as shown in FIG. 12, with the upper isolation insert 112 defined by a longitudinally slotted circumferential housing having perforations 130 at radially spaced intervals. The perforations or slots are preferably ⅛", and 20¾" length at 45 degrees of one another, depending upon the length of the tool. The isolation insert 112 is non-corrosive steel, aluminum, polypipe, plastic or other suitable material, with any size diameter from 2" to over several feet as long as it will fit into housing 115 but this may vary depending upon the desired length of the tool 110. The slots aid in gas separation as well as water/solid separation. A stainless-steel screen 116, matching the length and interior circumference is inserted in touching relation within the interior of the isolation section 112. The screen cage 116 may be inserted within the internal cavity 137 to line the interior cylindrical walls in touching relation to the perforations 130. The mesh screen is preferably 10 mesh, stainless steel but can be of different composition and still be within the scope of this disclosure.

Figures 11, 11A:
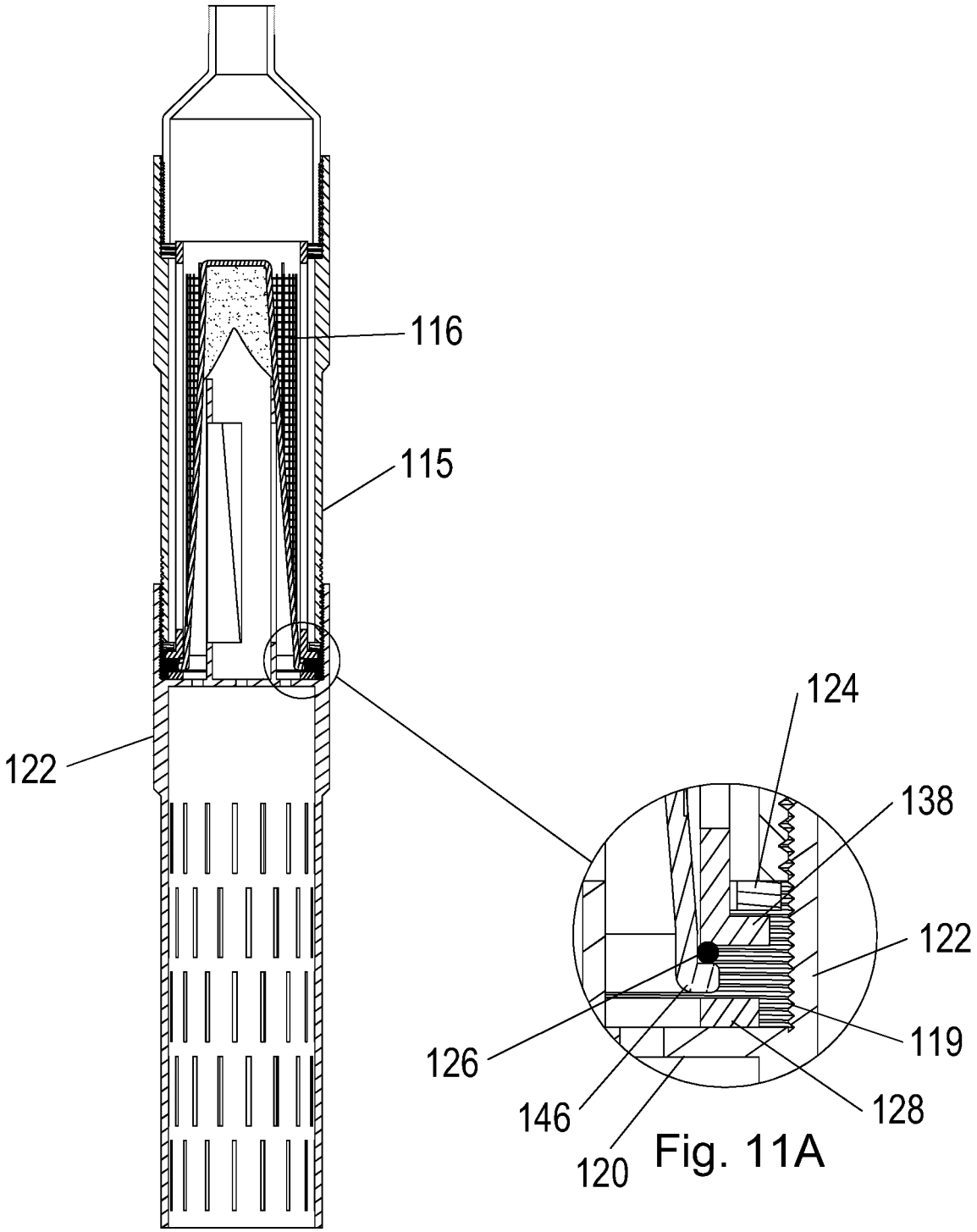
FIG. 11 is a cross-sectional view about lines 10-10 of FIG. 9.
FIG. 11A is a detail view of FIG. 11.

A gas/water internal separator support 114 comprising any size from 1" up to several feet in diameter as long as it will fit inside the hydrophobic sleeve 118 and then inside of isolation section 112. Slots are cut every 10 to 60 degrees and are at least or greater than 50% of the total length of 112. The separator support shell 114 is secured, preferably welded, to a baffle plate 120 that is welded to the slip collar 122. The baffle plate 120 has radially aligned perforations that aid in gas/water separation as well as blocking of large debris from passing therethrough. The slip collar 122 has internal threads (not shown) for threaded engagement with the housing 115, as described above. A gas/water hydrophobic sleeve 118 is placed over the support shell 114, the support shell 114 providing interior support for the separation tool/sleeve 118 and preventing it from collapsing within the isolation tool 112. The separation tool 118 includes a cylindrical rim member 146 that maintains the position of the sleeve member within the tool 110. The tool insert 112 in conjunction with steel compression rim ring 138, aluminum or steel compression ring 124, flange ring 146 and aluminum locking ring 128 ensure a tight connection within the tool as shown in FIGS. 11 and 11A. The sleeve member 118 is preferably made up of hydrophobic material having a single open end 144, closed end 142, and the cylindrical rim member 146 for lower support. The preferred material for the sleeve member 118 is polypropylene but may be comprised of any other hydrophobic fibers such as polyester, nylon, or polypropylene. These fibers may be in the form of staple yarns, flat continuous multi-filaments, or texturized continuous multi-filaments. The hydrophobic nature of the sleeve may also be accomplished using hydrophobic and super hydrophobic coatings such as polymethylhydrosiloxane (PMHS) and polyvinyl chloride (PVC), as an example. The sleeve member is preferably of 1 micron pore size but may also be in the range of 0.6 to 1.1 micron pore size to allow for passage of vaporized gas. The sleeve member 118 is inserted into the cavity 137 of tool insert 112 with the mesh screen 116 located therebetween. The placement of the mesh wire screen 116 between the interior of the tool insert 112 and the sleeve member 118 prevents the sleeve member 118 from passing through the perforations 130.

Figures 15, 16:
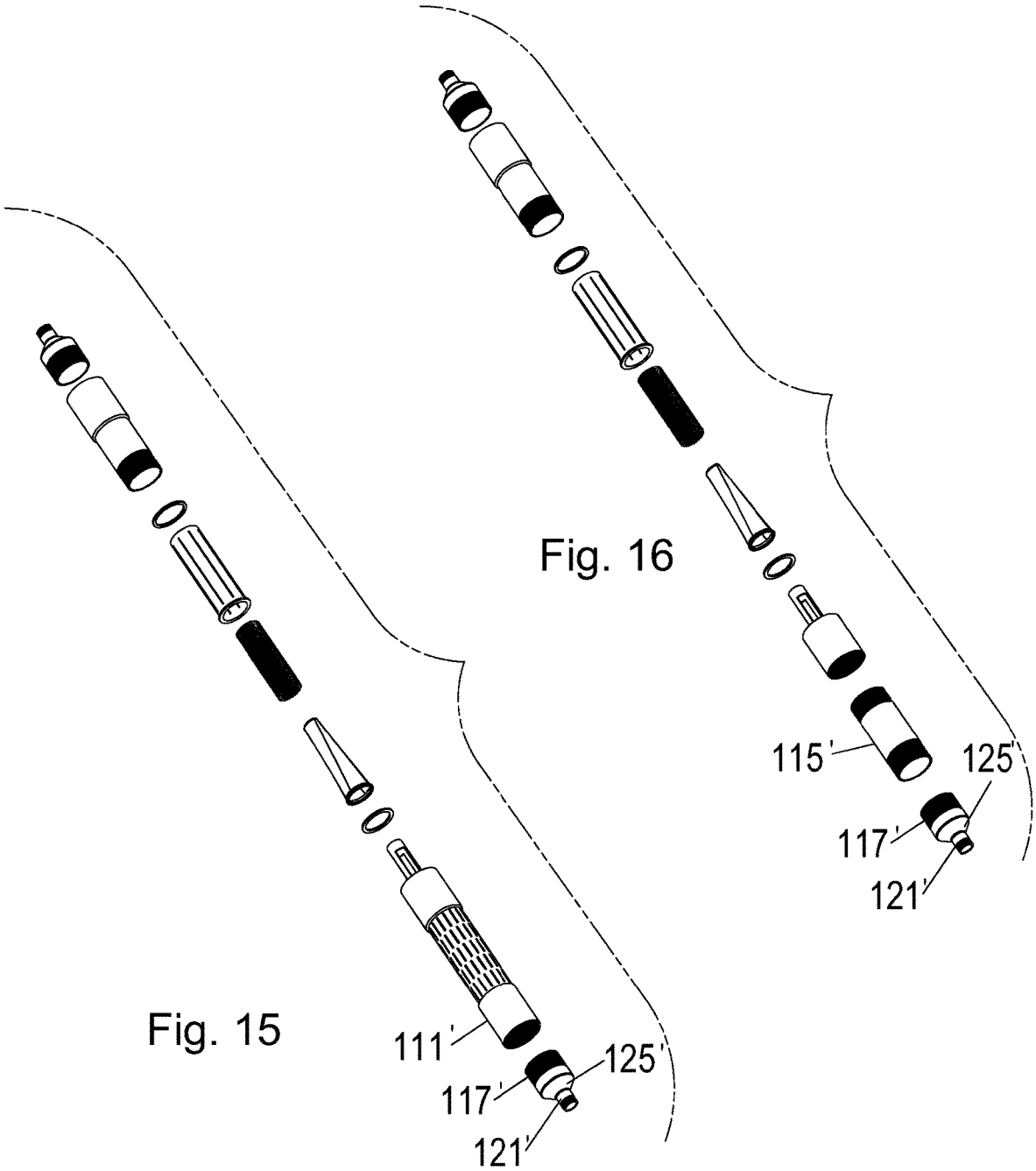
FIG. 15 is an exploded view of an alternate form of tool.
FIG. 16 is an exploded view of another alternate form of tool.

The bore tail 135 is of cylindrical configuration with circumferential perforations 148 in cylindrical wall 150 and also having dual openings 152, 154, acting as a solid separation tool. The perforations 148 are sized to allow passage of liquid therethrough but prevent passage of large solids into internal opening or cavity 154. The dimensional length of each portion of the tool is designed to allow fluid to travel the length of the lower and upper sections to allow for separation of the gas from the production fluid. Preferably, the upper and lower sections 113, 123 are of roughly the same length but variations in dimensions are possible without departing from the scope of the disclosure. Additional forms, shown in FIGS. 15 and 16, demonstrate use of multiple linking tools for use in a single formation. Housing 111' is secured to bore tail 135 and a neck coupling 121', collar 125' and lower threads 117' for threaded engagement with the housing 111'. Alternatively, housing 115' may be threadedly engaged with housing 122 at one end and threadedly engaged with neck coupling 121', collar 125' and threads 117'. In these forms, Tubing (not shown) may be inserted within neck coupling 121' for connection to a secondary tool, in the form as described above, in order to maximize separation of the gas from the production fluid with the well or formation.

In use, the tool 110 may be transported as separate parts and assembled on-site and set below the static water level in the wellbore. Due to the potential length of the tool, it may be more cost effective and easier to assemble on site. The lower section 123 of the tool 110 receives gas combined with formation liquid from the well reservoir through the encased well bore. The bore tail 135 restricts large solids from entering the bore tail passageway 154 due to the restrictive perforations 148. A mixture of gas and liquid is generated within the bore tail 135 with the pressure forcing the mixture through the baffle plate 120 and into the upper section 113 of the tool 110.

As an example, if the tool is set one hundred feet below the static fluid level this creates a hydrostatic pressure of approximately 43 psi at this depth under fresh (non-salt) water. The tubing T and tool annulus 132 are isolated from the approximately 43 psi of hydrostatic pressure by the sleeve membrane 118. The tubing pressure (and pipeline pressure) are preferably maintained at 5 psi to 20 psi. This creates a pressure sink inside the annulus 132 of the difference between the approximately 43 psi hydrostatic head and pressure inside the tool annulus 132; tubing T and the surface gas pipelines (not shown). For example, if the tubing T pressure is 10 psi, the pressure differential is 33 psi ((43 psi (hydrostatic head) −10 psi (tubing T pressure)). The side 160 of the hydrophobic membrane in contact with the formation water (opposite the wire mesh) is set at a depth in the wellbore such that the hydrostatic pressure at that depth is greater than the pressure on the side of the hydrophobic membrane that is in contact with the wire mesh 116 and insert tool 112 and consequently the annulus 132 that is in communication with the tubing T up to the surface.

By its very nature, gas will flow towards a point of lowest pressure in the wellbore. The gas dissolved in the coal (or other rock type) formation or production water will flow towards the pressure sink. The fluid will flow upwardly and into the bore tail 135 with the perforations 148 blocking solids from entering the tool. The fluid travels upwardly and pass through the baffle plate 120 which further aids in filtering out solids. The fluid then passes through the sleeve member 118, mesh screen 116 and perforated tool insert 112 as discussed previously. The gas is liberated from the fluid or water within the interior 144 of the sleeve member 118, pass through the hydrophobic membrane 118, the mesh cage 116, the tool insert perforations 130 and into the tool annulus 132. The liberated gas then travels upwardly through the tool and up the tubing T into the gas gathering pipeline. Formation fluid or water remains within the interior of the tool and generally is not forced upwardly into the tubing T due to the hydrophobic sleeve 118. Under certain conditions, the rock formations already possess liberated gas and it is not necessary to pump or remove de-gassed formation fluid.

While the present method and apparatus have been described in connection with the illustrated embodiments, it will be appreciated and understood that modifications may be made without departing, from the true spirit and scope.

We claim:

1. A downhole isolation tool for introduction within a casing of a gas formation, having an upper open end for reception of a tubing assembly, the tool comprising;

a circumferential multi-part housing with said upper open end; said housing having an internal cavity for insertion of a perforated cylindrical internal tool, a wire mesh screen, and a hydrophobic sleeve member; said hydrophobic member having a distal open end and a proximal closed end; and a perforated bore tail secured to said housing.

2. The isolation tool according to claim 1 wherein said circumferential housing and said bore tail include a plurality of threaded members.

3. The isolation tool according to claim 1 wherein said internal tool has radially spaced and vertically extending slotted openings, said slotted openings having a length that is longer in the longitudinal direction than in the axial or radial directions.

4. The isolation tool according to claim 1 wherein said hydrophobic sleeve member has a ring support.

5. The isolation tool according to claim 1 wherein said sleeve member has an inner support shell.

6. The isolation tool according to claim 5 wherein said inner support shell is defined by spaced slotted members and a baffle plate with radially aligned perforations.

7. The isolation tool according to claim 1 wherein said circumferential multi-part housing includes threaded members and rings for securement.

8. The isolation tool according to claim 1 wherein said bore tail has vertically extending and circumferentially located slots.

9. A downhole isolator comprising an external circumferential housing, a slotted cylindrical internal tool insert, a circumferential wire cage aligned in touching relation to said tool insert, a hydrophobic sleeve member having an open end with a ringed support member and a closed end; and a perforated bore tail.

10. The downhole isolator according to claim 9 wherein said isolator comprises upper and lower isolation sections with the upper isolation section defined by a tube section with an interior annulus for housing said internal tool insert.

11. The downhole isolator according to claim 10 wherein said upper section includes the external housing which is of cylindrical configuration having an upper neck coupling, cylindrical walls and threaded openings.

12. The downhole isolator according to claim 11 wherein said upper neck coupling is positioned below a water level with gas removal tubing passing therethrough.

13. The downhole isolator according to claim 9 wherein said tool insert is defined by cylindrical walls having circumferentially aligned, radially spaced perforations, an internal cavity, opposite open ends with one of said ends having an outwardly extending rim member.

14. The downhole isolator according to claim 9 wherein said hydrophobic sleeve member includes a cylindrical rim member that maintains the position of the sleeve member within the tool insert.

15. The downhole isolator according to claim 9 wherein said hydrophobic sleeve member includes an inner support shell.

* * * * *